US008403739B2

(12) United States Patent
Jackson

(10) Patent No.: US 8,403,739 B2
(45) **Date of Patent: *Mar. 26, 2013**

(54) MULTIPLAY POKER WAGERING GAME WITH PAYOUT DIFFERENTIATING DISPLAY OF PROBABILITIES

(75) Inventor: Kathleen Nylund Jackson, Scituate, MA (US)

(73) Assignee: IGT, Reno, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/325,975

(22) Filed: Dec. 14, 2011

(65) Prior Publication Data

US 2012/0088564 A1 Apr. 12, 2012

Related U.S. Application Data

(63) Continuation of application No. 11/516,989, filed on Sep. 7, 2006, now Pat. No. 8,083,578.

(60) Provisional application No. 60/714,642, filed on Sep. 7, 2005.

(51) Int. Cl.
*A63F 9/24* (2006.01)

(52) U.S. Cl. ..... 463/13

(58) Field of Classification Search ..... 463/13
See application file for complete search history.

(56) References Cited

U.S. PATENT DOCUMENTS

| | | | |
|---|---|---|---|
| 2,743,108 | A | 4/1956 | Sanders |
| 3,904,207 | A | 9/1975 | Gold |
| 4,363,485 | A | 12/1982 | Edwall |
| 4,582,324 | A | 4/1986 | Koza et al. |
| 4,618,150 | A | 10/1986 | Kimura |
| 4,652,998 | A | 3/1987 | Koza et al. |
| 4,659,087 | A | 4/1987 | Shen et al. |
| 4,695,053 | A | 9/1987 | Vazquez, Jr. et al. |
| 4,743,022 | A | 5/1988 | Wood |
| 4,775,155 | A | 10/1988 | Lees |
| 4,807,884 | A | 2/1989 | Breeding |

(Continued)

FOREIGN PATENT DOCUMENTS

| | | |
|---|---|---|
| GB | 2 096 376 | 10/1982 |
| GB | 2 097 160 | 10/1982 |

(Continued)

OTHER PUBLICATIONS

Third Party Submission in Published Application Under 37 C.F.R. § 1.99 filed for U.S. Appl. No. 13/325,975, dated Jun. 11, 2012 (2 pages).

(Continued)

*Primary Examiner* — Corbett B Coburn

(74) *Attorney, Agent, or Firm* — Neal, Gerber & Eisenberg LLP

(57) ABSTRACT

A method of operating a gaming system including, receiving an initial wager of a quantity of credits from a player to play a quantity of at least two poker hands, for each of the quantity of poker hands, displaying face-up a partial poker hand, automatically applying a first amount from the initial wager to each of the partial poker hands, wherein the sum of the first amounts of credits is less than the quantity of the initial wager, after displaying the partial poker hands face-up, enabling the player to select one of the partial poker hands, automatically applying a second amount from the initial wager to the player selected partial poker hand, wherein the second amount is equal to the initial wager minus the sum of the first amounts, and for each poker hand, determine and display a result and provide any awards associated with said displayed results.

12 Claims, 4 Drawing Sheets

U.S. PATENT DOCUMENTS

| | | | | |
|---|---|---|---|---|
| 4,836,553 | A | | 6/1989 | Suttle et al. |
| 4,844,464 | A | | 7/1989 | Berge |
| 4,856,787 | A | * | 8/1989 | Itkis ..... 273/237 |
| 4,861,041 | A | | 8/1989 | Jones et al. |
| 5,019,973 | A | | 5/1991 | Wilcox et al. |
| 5,033,744 | A | | 7/1991 | Bridgeman et al. |
| 5,087,405 | A | | 2/1992 | Maker |
| 5,098,107 | A | | 3/1992 | Boylan et al. |
| 5,100,137 | A | | 3/1992 | Fulton |
| 5,116,055 | A | | 5/1992 | Tracy |
| 5,154,429 | A | | 10/1992 | LeVasseur |
| 5,174,579 | A | | 12/1992 | Griffiths |
| 5,205,555 | A | | 4/1993 | Hamano |
| 5,248,142 | A | | 9/1993 | Breeding |
| 5,251,897 | A | | 10/1993 | Fulton |
| 5,275,400 | A | | 1/1994 | Weingardt et al. |
| 5,275,416 | A | | 1/1994 | Schorr et al. |
| 5,280,909 | A | | 1/1994 | Tracy |
| 5,288,077 | A | | 2/1994 | Jones |
| 5,292,127 | A | | 3/1994 | Kelly et al. |
| 5,322,295 | A | | 6/1994 | Cabot et al. |
| 5,334,836 | A | | 8/1994 | Filo |
| 5,342,047 | A | | 8/1994 | Heidel et al. |
| 5,342,049 | A | | 8/1994 | Wichinsky et al. |
| 5,344,144 | A | | 9/1994 | Canon |
| 5,362,053 | A | | 11/1994 | Miller |
| 5,364,105 | A | | 11/1994 | Jones |
| 5,377,973 | A | | 1/1995 | Jones et al. |
| 5,377,993 | A | | 1/1995 | Josephs |
| 5,390,934 | A | | 2/1995 | Grassa |
| 5,393,057 | A | | 2/1995 | Marnell, II |
| 5,393,067 | A | | 2/1995 | Paulsen et al. |
| 5,407,200 | A | | 4/1995 | Zalabah |
| 5,411,271 | A | | 5/1995 | Mirando |
| 5,417,430 | A | | 5/1995 | Breeding |
| 5,431,407 | A | | 7/1995 | Hofberg et al. |
| 5,452,899 | A | | 9/1995 | Skratulia et al. |
| 5,454,570 | A | | 10/1995 | Karal |
| 5,476,259 | A | | 12/1995 | Weingardt |
| 5,494,296 | A | | 2/1996 | Grassa |
| 5,529,309 | A | | 6/1996 | Bartlett |
| 5,531,440 | A | | 7/1996 | Dabrowski et al. |
| 5,531,448 | A | | 7/1996 | Moody |
| 5,536,016 | A | | 7/1996 | Thompson |
| 5,542,669 | A | | 8/1996 | Charron et al. |
| 5,560,603 | A | | 10/1996 | Seelig et al. |
| 5,570,885 | A | | 11/1996 | Ornstein |
| 5,577,731 | A | | 11/1996 | Jones |
| 5,584,485 | A | | 12/1996 | Jones et al. |
| 5,584,763 | A | | 12/1996 | Kelly et al. |
| 5,597,162 | A | | 1/1997 | Franklin |
| 5,611,730 | A | | 3/1997 | Weiss |
| 5,615,888 | A | | 4/1997 | Lofink et al. |
| 5,626,341 | A | | 5/1997 | Jones et al. |
| 5,632,485 | A | | 5/1997 | Woodland et al. |
| 5,639,088 | A | | 6/1997 | Schneider et al. |
| 5,639,089 | A | | 6/1997 | Matsumoto et al. |
| 5,641,730 | A | | 6/1997 | Brown |
| 5,645,486 | A | | 7/1997 | Nagao et al. |
| 5,649,705 | A | | 7/1997 | String |
| 5,651,548 | A | | 7/1997 | French et al. |
| 5,660,391 | A | | 8/1997 | Klasee |
| 5,660,393 | A | | 8/1997 | Dreger |
| 5,673,917 | A | | 10/1997 | Vancura |
| 5,678,821 | A | | 10/1997 | Hedman |
| 5,685,774 | A | | 11/1997 | Webb |
| 5,718,430 | A | | 2/1998 | Aramapakul et al. |
| 5,720,483 | A | | 2/1998 | Trinh |
| 5,732,950 | A | | 3/1998 | Moody |
| 5,735,742 | A | | 4/1998 | French |
| 5,743,523 | A | | 4/1998 | Kelly et al. |
| 5,755,619 | A | | 5/1998 | Matsumoto et al. |
| 5,769,716 | A | | 6/1998 | Saffari et al. |
| 5,772,506 | A | | 6/1998 | Marks et al. |
| 5,781,647 | A | | 7/1998 | Fishbine et al. |
| 5,788,573 | A | | 8/1998 | Baerlocher et al. |
| 5,788,574 | A | | 8/1998 | Ornstein et al. |
| 5,794,964 | A | | 8/1998 | Jones et al. |
| 5,795,225 | A | | 8/1998 | Jones et al. |
| 5,806,846 | A | | 9/1998 | Lofink et al. |
| 5,816,575 | A | | 10/1998 | Keller |
| 5,823,873 | A | | 10/1998 | Moody |
| 5,823,874 | A | | 10/1998 | Adams |
| 5,823,875 | A | | 10/1998 | Tarantino |
| 5,830,063 | A | | 11/1998 | Byrne |
| 5,833,536 | A | | 11/1998 | Davids et al. |
| 5,833,537 | A | | 11/1998 | Barrie |
| 5,839,730 | A | | 11/1998 | Pike |
| 5,845,906 | A | | 12/1998 | Wirth |
| 5,848,932 | A | | 12/1998 | Adams |
| 5,851,011 | A | | 12/1998 | Lott |
| 5,851,148 | A | | 12/1998 | Brune et al. |
| 5,855,515 | A | | 1/1999 | Pease et al. |
| 5,857,678 | A | | 1/1999 | Coleman et al. |
| 5,863,041 | A | | 1/1999 | Boylan et al. |
| 5,873,781 | A | | 2/1999 | Keane |
| 5,882,261 | A | | 3/1999 | Adams |
| 5,890,962 | A | | 4/1999 | Takemoto |
| 5,893,718 | A | | 4/1999 | O'Donnell |
| 5,911,418 | A | | 6/1999 | Adams |
| 5,911,419 | A | | 6/1999 | Delaney et al. |
| 5,927,714 | A | | 7/1999 | Kaplan |
| 5,935,002 | A | | 8/1999 | Falciglia |
| 5,941,769 | A | | 8/1999 | Order |
| 5,947,820 | A | | 9/1999 | Morro et al. |
| 5,947,822 | A | | 9/1999 | Weiss |
| 5,951,397 | A | | 9/1999 | Dickinson |
| 5,954,335 | A | | 9/1999 | Moody |
| 5,957,776 | A | | 9/1999 | Hoehne |
| 5,967,894 | A | * | 10/1999 | Kinoshita et al. ..... 463/13 |
| 5,976,016 | A | | 11/1999 | Moody et al. |
| 5,980,384 | A | | 11/1999 | Barrie |
| 5,984,310 | A | | 11/1999 | English |
| 5,997,401 | A | | 12/1999 | Crawford |
| 6,007,066 | A | | 12/1999 | Moody |
| 6,012,719 | A | | 1/2000 | Webb |
| 6,015,346 | A | | 1/2000 | Bennett |
| 6,019,369 | A | | 2/2000 | Nakagawa et al. |
| 6,039,650 | A | | 3/2000 | Hill |
| 6,047,963 | A | | 4/2000 | Pierce et al. |
| 6,050,895 | A | | 4/2000 | Luciano, Jr. et al. |
| 6,056,641 | A | | 5/2000 | Webb |
| 6,056,642 | A | | 5/2000 | Bennett |
| 6,059,289 | A | | 5/2000 | Vancura |
| 6,059,658 | A | | 5/2000 | Mangano et al. |
| 6,062,979 | A | | 5/2000 | Inoue |
| 6,062,981 | A | | 5/2000 | Luciano, Jr. |
| 6,089,976 | A | | 7/2000 | Schneider et al. |
| 6,089,978 | A | | 7/2000 | Adams |
| 6,093,102 | A | | 7/2000 | Bennett |
| 6,095,525 | A | | 8/2000 | Terminel |
| 6,098,985 | A | | 8/2000 | Moody |
| 6,102,798 | A | | 8/2000 | Bennett |
| 6,110,039 | A | | 8/2000 | Oh |
| 6,110,041 | A | | 8/2000 | Walker et al. |
| 6,110,043 | A | | 8/2000 | Olsen |
| 6,120,031 | A | | 9/2000 | Adams |
| 6,120,377 | A | | 9/2000 | McGinnis, Sr. et al. |
| 6,120,378 | A | | 9/2000 | Moody et al. |
| 6,126,541 | A | | 10/2000 | Fuchs |
| 6,126,542 | A | | 10/2000 | Fier |
| 6,126,547 | A | | 10/2000 | Ishimoto |
| 6,131,908 | A | | 10/2000 | Palmer |
| 6,135,884 | A | | 10/2000 | Hedrick et al. |
| 6,135,885 | A | | 10/2000 | Lermusiaux |
| 6,139,013 | A | | 10/2000 | Pierce et al. |
| 6,142,873 | A | | 11/2000 | Weiss et al. |
| 6,142,874 | A | | 11/2000 | Kodachi et al. |
| 6,146,273 | A | | 11/2000 | Olsen |
| 6,149,156 | A | | 11/2000 | Feola |
| 6,155,925 | A | | 12/2000 | Giobbi et al. |
| 6,159,095 | A | | 12/2000 | Frohm et al. |
| 6,159,096 | A | | 12/2000 | Yoseloff |
| 6,159,097 | A | | 12/2000 | Gura |
| 6,159,098 | A | | 12/2000 | Slomiany et al. |
| 6,165,069 | A | | 12/2000 | Sines et al. |
| 6,165,070 | A | | 12/2000 | Nolte et al. |

6,174,233 B1 1/2001 Sunaga et al.
6,174,235 B1 1/2001 Walker et al.
6,179,291 B1 1/2001 Vancura
6,186,894 B1 2/2001 Mayeroff
6,190,255 B1 2/2001 Thomas et al.
6,196,547 B1 3/2001 Pascal et al.
6,203,010 B1 3/2001 Jorasch et al.
6,206,780 B1 3/2001 Awada
6,210,279 B1 4/2001 Dickinson
6,220,593 B1 4/2001 Pierce et al.
6,220,961 B1 4/2001 Keane et al.
6,224,482 B1 5/2001 Bennett
6,224,484 B1 5/2001 Okuda et al.
6,227,969 B1 5/2001 Yoseloff
6,231,442 B1 5/2001 Mayeroff
6,231,445 B1 5/2001 Acres
6,234,897 B1 5/2001 Frohm et al.
6,237,917 B1 5/2001 Timpano
6,238,288 B1 5/2001 Walker et al.
6,254,481 B1 7/2001 Jaffe
6,261,177 B1 7/2001 Bennett
6,267,669 B1 7/2001 Luciano, Jr. et al.
6,270,405 B1 8/2001 Ferguson
6,270,409 B1 8/2001 Shuster
6,270,412 B1 8/2001 Crawford et al.
6,293,866 B1 9/2001 Walker et al.
6,299,536 B1 10/2001 Hill
6,305,686 B1 10/2001 Perrie et al.
6,309,298 B1 10/2001 Gerow
6,309,299 B1 10/2001 Weiss
6,311,978 B1 11/2001 Moody
6,312,330 B1 11/2001 Jones et al.
6,312,334 B1 11/2001 Yoseloff
6,313,871 B1 11/2001 Schubert
6,315,291 B1 11/2001 Moody
6,332,614 B1 12/2001 Hesse
6,334,814 B1 1/2002 Adams
6,336,859 B2 1/2002 Jones et al.
6,336,862 B1 1/2002 Byrne
6,345,824 B1 2/2002 Selitzky
6,346,044 B1 2/2002 McCrea, Jr.
6,347,996 B1 2/2002 Gilmore et al.
6,364,313 B1 4/2002 Moody
6,371,867 B1 4/2002 Webb
6,375,189 B1 4/2002 Jones
6,386,977 B1 5/2002 Hole
6,398,644 B1 6/2002 Perrie et al.
6,402,147 B1 6/2002 Lo
6,416,409 B1 7/2002 Jordan
6,419,578 B1 7/2002 Moody et al.
6,419,583 B1 7/2002 Crumby et al.
6,425,823 B1 7/2002 Byrne
6,428,412 B1 8/2002 Anderson et al.
6,435,511 B1 8/2002 Vancura et al.
6,443,837 B1 9/2002 Jaffe et al.
6,457,714 B1 10/2002 Feola
6,461,240 B1 10/2002 Perkins
6,461,241 B1 10/2002 Webb et al.
6,464,582 B1 10/2002 Baerlocher et al.
6,467,771 B1 10/2002 deKeller
6,471,208 B2 10/2002 Yoseloff et al.
6,471,591 B1 10/2002 Crumby
6,474,646 B1 11/2002 Webb
6,475,088 B1 11/2002 Jones et al.
6,481,713 B2 11/2002 Perrie et al.
6,482,089 B2 11/2002 Demar et al.
6,485,368 B2 11/2002 Jones et al.
6,511,068 B1 1/2003 Sklansky et al.
6,514,140 B1 2/2003 Storch
6,517,073 B1 2/2003 Vancura
6,517,074 B1 2/2003 Moody et al.
6,523,831 B2 2/2003 Webb
6,532,291 B1 3/2003 McGrath
6,533,276 B2 3/2003 Soltys et al.
6,533,658 B1 3/2003 Walker et al.
6,537,150 B1 3/2003 Luciano et al.
6,547,242 B1 4/2003 Sugiyama et al.
6,553,276 B2 4/2003 Akram et al.
6,561,898 B2 5/2003 Moody
6,568,680 B1 5/2003 Moody et al.
6,569,015 B1 5/2003 Baerlocher et al.
6,572,471 B1 6/2003 Bennett
6,599,192 B1 7/2003 Baerlocher et al.
6,607,195 B2 8/2003 Vancura
6,609,711 B1 8/2003 Campbell
6,645,073 B2 11/2003 Lemay et al.
6,648,759 B2 11/2003 Vancura
6,652,377 B1 11/2003 Moody
6,652,378 B2 11/2003 Cannon et al.
6,656,040 B1 12/2003 Brosnan et al.
6,656,047 B1 12/2003 Tarantino et al.
6,672,959 B2 1/2004 Moody et al.
6,672,975 B1 1/2004 Galloway
6,682,419 B2 1/2004 Webb et al.
6,682,420 B2 1/2004 Webb et al.
6,692,003 B2 2/2004 Potter et al.
6,692,355 B2 2/2004 Baerlocher et al.
6,702,289 B1 3/2004 Feola
6,726,427 B2 4/2004 Jarvis et al.
6,726,561 B2 4/2004 Crawford
6,733,389 B2 5/2004 Webb et al.
6,749,200 B2 6/2004 Yurkins
6,758,750 B2 7/2004 Baerlocher et al.
6,772,975 B2 8/2004 Sommerfeld et al.
6,776,415 B2 8/2004 Robinson et al.
6,789,800 B2 9/2004 Webb
6,793,578 B2 9/2004 Luccesi et al.
6,802,773 B2 10/2004 Moody
6,808,173 B2 10/2004 Snow
6,827,348 B1 12/2004 Mitchell
6,832,957 B2 12/2004 Falconer
6,840,517 B2 1/2005 Snow et al.
6,845,981 B1 1/2005 Ko
6,848,994 B1 2/2005 Knust et al.
6,852,030 B2 2/2005 Baerlocher et al.
6,857,958 B2 2/2005 Osawa
6,869,074 B2 3/2005 Miller
6,869,075 B1 3/2005 Stavinsky
6,874,786 B2 4/2005 Bruno et al.
6,877,748 B1 4/2005 Patroni et al.
6,878,064 B2 4/2005 Huang
6,884,168 B2 4/2005 Wood et al.
6,896,620 B1 5/2005 Luciano et al.
6,902,167 B2 6/2005 Webb
6,923,446 B2 8/2005 Snow
6,938,900 B2 9/2005 Snow
6,955,356 B2 10/2005 Moody
6,964,418 B2 11/2005 Moody
7,017,805 B2 3/2006 Meehan
7,018,291 B1 3/2006 Lemke et al.
7,056,208 B2 6/2006 Cogert
7,114,718 B2 10/2006 Grauzer et al.
7,137,628 B2 11/2006 Moody
7,137,630 B2 11/2006 Yurkins
7,156,397 B2 1/2007 Moody et al.
7,222,857 B2 5/2007 Moody
7,222,858 B2 5/2007 Moody
7,316,613 B2 1/2008 Luccesi et al.
7,329,179 B2 2/2008 Baerlocher
7,404,762 B2 7/2008 Moody
7,431,644 B2 10/2008 Moody
7,594,851 B2 9/2009 Falconer
7,658,673 B2 2/2010 Baerlocher et al.
2001/0000933 A1 5/2001 Koelling
2001/0035610 A1 11/2001 Webb
2001/0054796 A1 12/2001 Lo
2002/0028710 A1 3/2002 Ishihara et al.
2002/0034974 A1 3/2002 Wood et al.
2002/0045472 A1 4/2002 Adams
2002/0094855 A1 7/2002 Berman
2002/0177480 A1 11/2002 Rowe
2002/0198036 A1 12/2002 Baerlocher et al.
2003/0057648 A1 3/2003 Webb
2003/0064772 A1 4/2003 Tempest et al.
2003/0064785 A1 4/2003 Stone et al.
2003/0069064 A1 4/2003 Ainsworth
2003/0071418 A1 4/2003 Saucier
2003/0100357 A1 5/2003 Walker et al.

| | | | | |
|---|---|---|---|---|
| 2003/0151194 | A1 | 8/2003 | Hessing et al. | |
| 2003/0171142 | A1 | 9/2003 | Kaji et al. | |
| 2003/0181231 | A1 | 9/2003 | Vancura et al. | |
| 2003/0207709 | A1 | 11/2003 | Paotrakul | |
| 2003/0207710 | A1 | 11/2003 | Rodgers et al. | |
| 2003/0211884 | A1 | 11/2003 | Gauselmann | |
| 2003/0236116 | A1 | 12/2003 | Marks et al. | |
| 2004/0029631 | A1 | 2/2004 | Duhamel | |
| 2004/0053673 | A1 | 3/2004 | Mishra | |
| 2004/0053683 | A1 | 3/2004 | Hartl et al. | |
| 2004/0070146 | A1 | 4/2004 | Snow | |
| 2004/0072619 | A1 | 4/2004 | Brosnan et al. | |
| 2004/0152509 | A1 | 8/2004 | Hornik et al. | |
| 2004/0164491 | A1 | 8/2004 | Webb | |
| 2004/0183256 | A1 | 9/2004 | Ko | |
| 2004/0195770 | A1 | 10/2004 | Ornstein | |
| 2004/0224777 | A1 | 11/2004 | Smith et al. | |
| 2004/0251630 | A1 | 12/2004 | Sines et al. | |
| 2004/0266507 | A1 * | 12/2004 | Cooper | 463/13 |
| 2005/0012273 | A1 | 1/2005 | Bruno et al. | |
| 2005/0026680 | A1 | 2/2005 | Gururajan | |
| 2005/0026683 | A1 | 2/2005 | Fujimoto | |
| 2005/0029743 | A1 | 2/2005 | Daines | |
| 2005/0051963 | A1 | 3/2005 | Snow | |
| 2005/0054408 | A1 | 3/2005 | Steil et al. | |
| 2005/0059461 | A1 | 3/2005 | Ching et al. | |
| 2005/0073100 | A1 | 4/2005 | Falciglia, Sr. | |
| 2005/0073102 | A1 | 4/2005 | Yoseloff et al. | |
| 2005/0082758 | A1 | 4/2005 | Sklansky et al. | |
| 2005/0116414 | A1 | 6/2005 | Yurkins | |
| 2005/0119047 | A1 | 6/2005 | Olive | |
| 2005/0143168 | A1 | 6/2005 | Torango | |
| 2005/0161882 | A1 | 7/2005 | Miller | |
| 2005/0164760 | A1 | 7/2005 | Moody | |
| 2005/0176488 | A1 | 8/2005 | Olive | |
| 2005/0209004 | A1 | 9/2005 | Torango | |
| 2005/0239542 | A1 | 10/2005 | Olsen | |
| 2005/0269776 | A1 | 12/2005 | Miller | |
| 2005/0282622 | A1 | 12/2005 | Lindquist | |
| 2006/0001211 | A1 | 1/2006 | Lewis et al. | |
| 2006/0027970 | A1 | 2/2006 | Kyrychenko | |
| 2008/0113759 | A1 | 5/2008 | Baerlocher | |
| 2009/0005144 | A1 | 1/2009 | Moody | |

FOREIGN PATENT DOCUMENTS

| | | |
|---|---|---|
| GB | 2 100 905 | 1/1983 |
| GB | 2 117 952 | 10/1983 |
| GB | 2 137 392 | 10/1984 |
| GB | 2 153 572 | 8/1985 |
| GB | 2 161 008 | 1/1986 |
| GB | 2 161 009 | 1/1986 |
| GB | 2 170 636 | 8/1986 |
| GB | 2 180 682 | 4/1987 |
| GB | 2 181 589 | 4/1987 |
| GB | 2 183 882 | 6/1987 |
| GB | 2 191 030 | 12/1987 |
| GB | 2 222 712 | 3/1990 |
| GB | 2 226 907 | 7/1990 |
| GB | 2 408 951 | 6/2005 |
| WO | WO 98 51384 | 11/1998 |
| WO | WO 2005 037385 | 4/2005 |
| WO | WO 2005 043475 | 5/2005 |
| WO | WO 2005 081958 | 9/2005 |
| WO | WO 2005 083599 | 9/2005 |

OTHER PUBLICATIONS

Description of Poker written by Hoyle's Rules of Games published 1946-1983.

Non-Final Office Action dated May 5, 2010 re: U.S. Appl. No. 11/516,989.

Final Office Action dated Sep. 10, 2010 re: U.S. Appl. No. 11/516,989.

Final Office Action dated Feb. 11, 2011 re: U.S. Appl. No. 11/516,989.

Final Office Action dated May 24, 2011 re: U.S. Appl. No. 11/516,989.

* cited by examiner

MULTIPLAY POKER WAGERING GAME WITH PAYOUT DIFFERENTIATING DISPLAY OF PROBABILITIES

This application is a continuation application of, claims priority to and the benefit of U.S. patent application Ser. No. 11/516,989, filed on Sep. 7, 2006, which issued as Pat. No. 8,083,578 on Dec. 27, 2011, which claims the benefit of and priority to U.S. Provisional Patent Application No. 60/714,642, filed 7 Sep. 2005, the contents of which are each incorporated by reference herein.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

1. Field of the Invention

The present invention relates to wagering games, particularly wagering games using playing cards or images of playing cards, and wagering games played on casino tables, video machines, multi-player platforms or the internet.

2. Background of the Art

Among the successful poker game variants are Let It Ride Bonus™ poker, Three Card Poker™ game and Caribbean Stud™ poker. These games have each achieved a high level of commercial success with different formats and attributes.

Let It Ride™ stud poker is described in U.S. Pat. No. 5,288,081. The Bonus version of the game is described in U.S. Pat. No. 6,273,424. In this game, the player makes a wager in three parts, three cards are dealt to each player (there may be only a single player), and two common cards are dealt face down in front of the dealer. The player examines his/her three cards, evaluates the likelihood of a ranked hand (e.g., at least a pair of tens) being achieved with those three cards and the as yet unseen common cards. The player, based on judgment of that likelihood, may elect to withdraw the first of the three-part wager or keep the wager at risk. Upon the player making that decision, and withdrawing or allowing the first wager to remain at risk, a first of the common cards is turned face up. The player then can make another decision with regard to the play of the hand and whether there is a changed potential for a ranked hand. A second portion of the three-part wager is then withdrawn or allowed to remain at risk. After this decision, the last common card is exposed, and the rank of each player's hand, including the common cards, is evaluated. Payments are made to each player based on only the rank of hand achieved and the number of wagers left on the table from the original three-part wager. As noted, at least one wager must remain, as only two parts can have been withdrawn. Wagers are paid off at rates (or odds), for example, of 1:1 for pairs of at least 10's, 2:1 for two pairs, 3:1 for three-of-a-kind, 5:1 for straights, 7:1 for flushes, 12:1 for full houses, 50:1 for four-of-a-kind, 250:1 for straight flushes, and 1000:1 for Royal Flushes. The specific payout odds can be varied and often casinos choose payout tables that help them achieve a desired percentage hold. Side bonus wagers may also be placed in which ranked hands over three-of-a-kind receive fixed or progressive bonuses, such as $25,000 for a Royal Flush. The bonus payouts and hand combinations are typically displayed on a payout table on the table surface. The winning bonus combinations are typically a higher-ranking subset of the winning base game outcomes.

Texas Hold'Em and Omaha poker are among the most played casino and club table poker games and have achieved new celebrity status because of extensive television coverage of tournament games. There are also variants of the game that have been known in the industry for years, such as a game called "Fast Action Hold'Em" that was originally licensed in New Jersey in the 1990's The substantive content of the disclosure of Fast Action Hold'Em, as confirmed by multiple sources (including the New Jersey CCC publication) is as follows:

Each player is dealt four cards.

Each player keeps two cards (by the player's choice) and the other two cards are discarded.

The dealer is also dealt four cards (face down).

The dealer keeps two cards and discards the other two cards.

Five "Community" cards are dealt face-up. These cards are called community cards because both the player and the dealer use these cards.

To win, the player's hand must be better than the dealer's hand. The dealer wins ties.

The player's hand is the best 5-card hand made up of any combination of the player's two cards and the five community cards.

In this game, the player either wins or loses—there is no bonus payoff for really strong hands.

If the player wins, the amount anted is doubled (1:1 payout). If the player loses, the ante is lost. In basic essentials, the game is a direct play of Omaha poker (itself a variant of Hold'Em poker) played directly against a dealer.

U.S. patent application Ser. No. 20050107148 (WEBB), describes a house banked casino game simulates play of Texas Hold'Em. Each player places a competition wager, which is without a house advantage, and each player places a proposition wager. Hands of playing cards are dealt to each player, and at least one least community card is dealt to a community card area. The competition wager is resolved according to a poker rank of one player hand against a poker rank of another player hand, and the proposition wager is resolved according to the poker rank of each player hand against a payout scale. The rules are simple to execute and play eliminating skill decisions, thereby appealing to average or inexperienced players. The proposition wager further increases player interest by providing a chance for a high payout.

U.S. Pat. No. 6,503,145 (WEBB) describes a casino game that incorporates at least a first compulsory playing mode and one or more optional playing modes without a house advantage. Preferably, the first playing mode is a three-, five- or seven-card poker game against a payout scale based on the respective hand poker rank or against both a payout scale and the dealer. Optional modes without a house advantage include head-to-head poker games against the dealer only and poker games against other players. Side wager options are also available for high hands, thereby increasing player interest by providing a chance for a high payout.

U.S. patent application Ser. No. 20040266507 (COOPER) describes a device and method for playing a game where the player allocates a game wager among a plurality of game hands, the cards of which are undisclosed. Upon allocation, the cards of the game hands are revealed and the player wins or loses based upon the holding of each game hand. In a further embodiment, information concerning winning holdings may be imparted to the player prior to allocation and revelation of the game hands cards.

U.S. patent application Ser. No. 20040113363 (MOODY) describes a game in which a player makes a wager which is allocated among a plurality of stud poker hands to be played by the player. One of the wagers is allocated to a full hand of cards and the other wagers are allocated among poker hands that are comprised of various subsets of the full hand. The player is then dealt the full hand of cards. The player wins or loses depending on the stud poker hand ranking of the full hand. The various subsets of hands are then analyzed to determine whether there are any winning hand combinations among the subset of hands. Awards for winning hand combinations are made to the player based on the poker hand ranking of each subset hand and the full hand according to a pay table and the amount wagered by the player on each subset hand and the full hand.

U.S. patent application Ser. No. 20030022709 (AWADA) describes a wagering game on gaming machines. In one of three table games and in one of two games played on a gaming machine, three card Stud Poker, five card Stud Poker and seven card Stud Poker are combined. In a second table game, five card Stud Poker and Seven Card Stud Poker are combined. In a third table game three card Stud Poker and seven card Stud Poker are combined. In a second game played on the gaming machine, five card Draw Poker and seven card Stud Poker are combined.

U.S. patent application Ser. No. 20020103018 (ROMMERDAHL) describes a method and game system for playing multiple contests utilizing one or more cards from a single set of cards. In one or more embodiments, the gaming system includes a game engine and an evaluator. Embodiments of the invention include an intelligent, poker playing slot machine that allows a user to play poker for money against one or more intelligent or non-intelligent, simulated opponents. In one embodiment, the gaming system includes a simulation engine which generates actions for the simulated player(s). The simulation engine allows a real person, or user, to play against intelligent, simulated opponents. In one or more embodiments of the invention, the gaming system permits a user-player to play first and second poker contests. In one embodiment, one or more cards which are dealt to a player for use in the first contest are used in the play of the second contest. In one or more embodiments, one of the contests comprises a video-poker type game. When a user-player plays against the simulated opponent, the gaming system may include a static evaluator for determining whether the user-player is a winner of the video-poker type game by comparison to predetermined criteria. Other aspects of the invention include payout and jackpot arrangements for multiple contests.

U.S. Pat. No. 6,695,695 (ANGEL) describes a video implemented casino card game that deals multiple hands. In a preferred embodiment the game includes a means for simulating a plurality of players on a game display. Each simulated player is dealt a hand of cards pursuant to a predetermined card game selected by a game player. Subsequent to the initial deal, the game player selects which hand to play. Once the hand has been selected, each hand is fully played. Only the game player's hand is fully revealed during play. Based on the game player's final cards, the player is paid according to a pay table. Thereafter, all hands are revealed and the game player is paid a bonus amount if the player's selected hand is the highest hand of the dealt hands. In a card game requiring a draw, or decision, unselected card hands are played according to a preprogrammed methodology within a gaming machine's internal microprocessor.

U.S. Pat. No. 6,402,150 (JONES) describes that in a casino card game, provisions are made for a jackpot component awarded after initially dealt cards are reviewed and additional cards are dealt, in which predetermined prizes are awarded players who participate in the jackpot component by placing additional wagers and the prizes are based upon preselected arrangements of playing cards in the hands after additional cards are dealt.

U.S. Pat. No. 5,664,781 (FEOLA) describes a casino card game that allows players to wager against the casino using the rules of stud poker. A number of stud poker hands are dealt as lines on a playing surface and players wager as to which hand will have the highest stud poker ranking. The playing surface has a dealer position including a line for each hand dealt, and player positions in a semicircle around the dealer position, each including a location at which wagers are placed. Game options include choosing the hand with the lowest ranking instead of the highest ranking, having indicators that indicate the hands with the currently highest and/or lowest ranking, requiring an ante or vigorish if only two hands are played, playing with more than one deck of playing cards, allowing one of the players to be the bank, playing on a video machine, a personal computer, a slot machine, over an on-line computer network, or on another type of one-way or interactive gaming or entertainment equipment, and playing with a match jackpot and/or a tough beat jackpot.

U.S. Pat. Nos. 6,206,373 and 6,637,747 (GARROD) describe variations on the play of Omaha Poker, which is a variant of Texas Hold'Em poker. In addition to a unique format of play in which a card is "specified to the dealer's hand" (that is a card of a specific rank is given to the dealer as part of the dealer's hand, a concept not envisioned by Shuffle Master, Inc. as meaningful to the art), the patents and claims are alternatively directed towards more fundamental formats of Hold'Em poker play formats.

U.S. Pat. No. 5,573,249 (JOHNSON) describes a method for playing a card game comprising the steps of providing at least one player with an opportunity to place a wager, displaying a first plurality of playing card indicia to form a plurality of partial card hands, allowing the player to assign the wager to one of the plurality of partial card hands, and subsequently completing the card hands by displaying an additional plurality of card indicia. When the hands have been completed, a winning payout is provided to any and all players who successfully assigned their wagers to the partial card hand which resulted in the complete hand having a particular value, e.g. the highest poker ranking.

SUMMARY

A method of playing a poker event wagering game comprises:

a player placing an underlying wager of X credits in the wagering game where Z partial hands are provided in a display step in the wagering game;

displaying Z partial hands in the display step;

the player wagering Y credits on one of the Z partial hands as a wager that the one of the Z partial hands will be a best hand from among all Z hands at the conclusion of the poker wagering game when the final hands will comprise N cards, wherein $Y<X$; and X-Y credits being wagered against a paytable for ranks attained against the paytable for each distinct numbers of cards in the Z hands selected from the group consisting of partial hands, intermediate hands and final hands of N cards.

DETAILED DESCRIPTION

Figure 1:
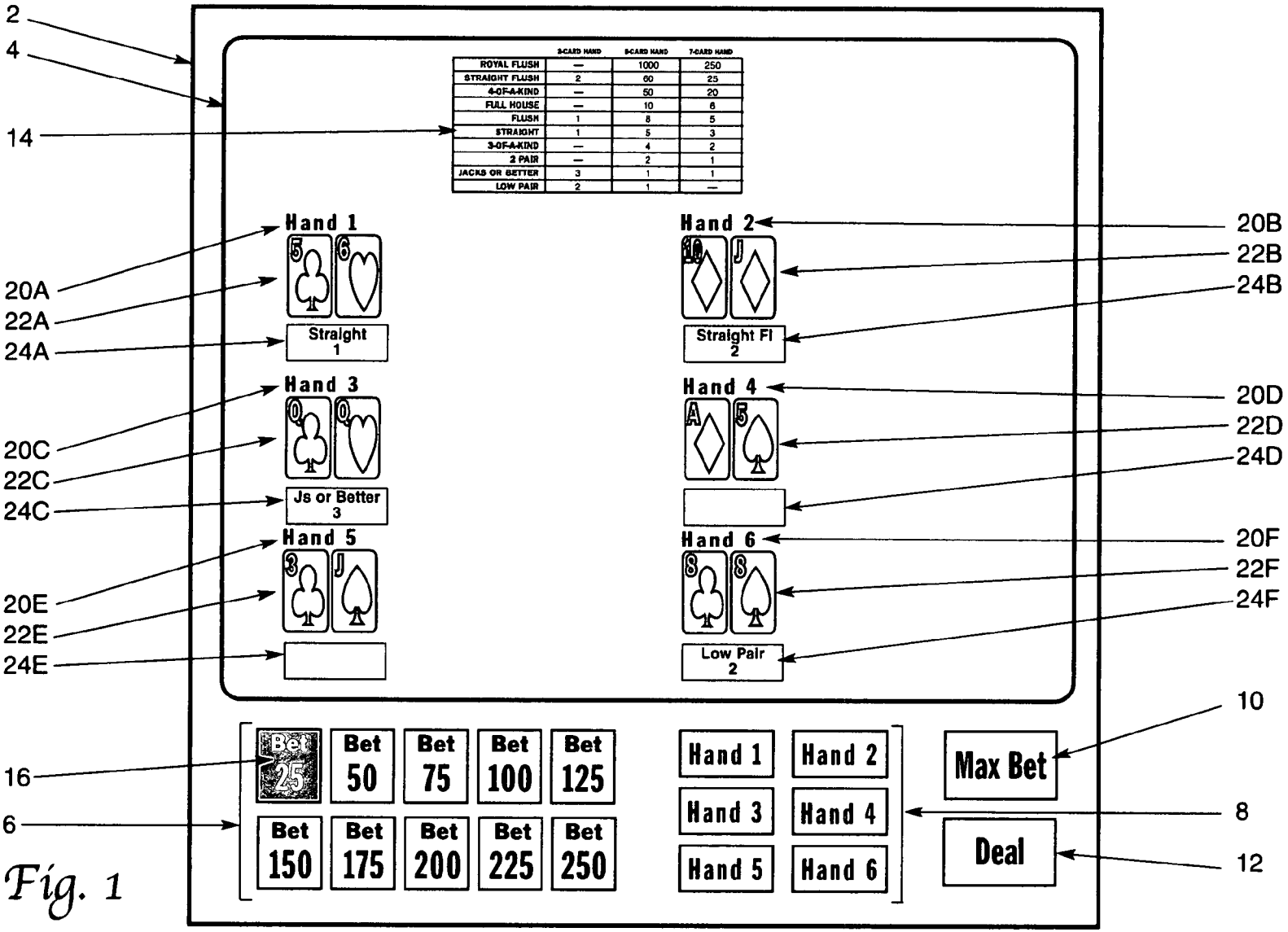
FIG. 1 shows a screen monitor for the use of this invention at an early stage of play.

The game described herein will be referred to under the generic concept name of MegaStudPoker™, which may have variants within the generic disclosure provided herein. As with all poker-type games, the game depends upon the rank of cards and combinations of cards in a hand and not on point count total. The game may be played as both a table game or automated machine game, with the latter preferred.

One way of generally described technology included in this disclosure comprises a method of playing a poker wagering game on a video gaming apparatus. The method comprises:

a player placing an underlying wager of X credits in the wagering game where Z partial hands are provided in a display step in the wagering game;

displaying Z partial hands in the display step;

the player wagering Y credits on one of the Z partial hands as a wager that the one of the Z partial hands will be a best hand from among all Z hands at the conclusion of the poker wagering game when the final hands will comprise N cards, wherein Y<X; and X-Y credits being wagered against a paytable for ranks attained against the paytable for each distinct numbers of cards in the Z hands selected from the group consisting of partial hands, intermediate hands and final hands of N cards. Upon displaying Z partial hands in the display step, individual probabilities for each of the Z hands winning in an N card final hand game against all of the other Z hands is displayed for use by the player. Distinct payout rates may be displayed for each of the individual probabilities displayed. The distinct payout rates are relatively inverse (that is, they do not have to be literal mathematic inverses, which might leave factors that cannot wholly be applied to wager returns (e.g., an inverse of 1/7 would require a literal inverse multiple of 14.2856 . . . as a payout factor, which is not convenient in dealing with whole unit credits) to the displayed probability of one Z hand winning, such that higher probability winning hands have lower payout rates as compared to lower probability winning hands. Again, in explaining "relatively inverse," on the 1/7 probability of winning displayed in a seven partial hand game, acceptable payout rates are likely to be in a relative range of 8:1 to 14:1, with the residual providing house retention attributes. The method is preferred where N comprises 7; each partial hand consists of two cards; the final 7 cards in the Z hands are formed by first providing the initial two card partial hand and then providing a flop of three community cards to form a first intermediate hand before additional community cards are provided to form a final hand of 7 cards; and the additional community cards to form a final hand of seven cards are provided together as two cards.

To initiate the game, a player will wager X number of credits on Z numbers of hands. For simplicity, it will be assumed that X/Z is a whole integer, but in automated or table games, the wagers may be asymmetrically distributed. The Z number of hands will each have a predetermined number of cards that are used as separate partial hands. In the play of Texas Hold'Em variants, that would be 2 cards, and in Omaha poker variants, that would be four cards. Each round of play for each player has three distinct and separate hands that are in play at different stages.

After receiving the Z number of partial hands (e.g., 2 cards will be discussed, using a Texas Hold'Em format), a sequence of flop cards (community cards) are provided, preferably as a first 3-card flop, and then a next 2-card flop (equivalent to a combination of the Fourth Street and River cards in Texas Hold'Em). It is possible to provide the second set of cards as two distinct offerings as the Fourth Street and the River. X, Y, Z and N are whole integer numbers. As X and Y are wagering credits, they may vary up to the wagering limits on the game. Z is preferably between 2 and 100 (with multiple decks needed for values in excess of 23 (where there is a standard 52 card deck) and in excess of 24 (where there is a standard 52 card deck and at lest one wild card or extra card). N is at least one number greater than the number of cards in the partial hands, preferably 3-6 cards greater, and more preferably exactly 5 cards greater.

In one format of the game, the player has placed a three-part wager on a 2-card hand (the pocket cards or partial hand), a 5-card hand (the partial hand(s) and the 3-card flop) and a 7-card hand (the partial hand of 2 cards, the flop of 3 cards and the final set of two cards equivalent to Fourth Street and the River cards).

In another format of the game, there may be four wagers, on the 2-card partial hands, the 3-card flop, the 5-card combination of partial hand and flop, and the 7-card hand of the partial hand and the 5 community cards. As noted before, it is an option to deliver Fourth Street and the River separately, and if that is done, there is a possibility of five wagers on the 2-card partial hand, the 3-card flop, the 5-card partial hand plus flop, the 6-card hand of the partial hand, flop and Fourth Street, and then the 7-card hand as described above with the River added. Sub-combinations of these wagers may also be structured into the game.

Each number of cards in hands will have separate pay tables for the wagers, as the probability of ranked hands (beginning with a pair for examination) increases dramatically with each successive card. The preferred structure of the game is the 2-card hand, 5-card hand and 7-card hand. The wagers are made against a paytable in all instances, not against a dealer's hand (there is no dealer's hand). The game is played with one standard deck of 52 cards (or with one or more wild cards). Pocket cards are all different among the Z number of hands, while the flop, and river/turn cards are the same for each of the Z number of hands.

When done automatically, a portion of the total wager made by each player is distributed into as close to equal parts among the (for example) 3 hands (2-card, 5-card and 7-card) that are formed for each of the Z number of hands. In this manner, each of the Z number of hands has nearly the same credits wagered for each particular part, i.e., all parts A (2-card poker wager) would have the same wager, all parts B (5-card poker wager) would have the same wager, and all parts C (7-card poker wager) would have the same wager.

The total number of credits wagered on the total parts (Z[A+B+C]) is less than X. At least a portion if not all of the remaining credits are bet on picking which hand will eventually become the top winning hand of 7-card stud when all hands are filled in and compared. For example, if there are three partial hands available and 11 credits are wagered, then there will be one credit each wagered on the three 2-card hands (A, B and C), one credit each wagered on the three 5-card hands (A, B and C), one credit each wagered on the three 7-card hands (A, B and C), for a total of 9 credits wagered. The remaining 2 credits are placed by the player on selecting which one (or more, by splitting the remaining two credits) of the three partial hands will eventually form the highest ranked hand among the three partial hands. The rules may require that there be at least one credit in every play wagered on the highest rank for the partial hands, and there may be a minimum amount required that is less than, equal to or greater than the largest wager or smallest wager placed on the 3-Part wager (e.g., 2-card, 5-card and 7-card wagers).

After the 2 pocket cards in each hand are dealt, the screen may display the probability or chances (e.g., as a percentage) of each 2 cards becoming the winning 7-card stud hand (C), and/or of having a ranked hand in the 5-card event. This percentage may be and preferably is displayed prior to the player committing the wager on the best of the Z number of 7-card hands that will be the final result.

For example, a pair of Aces being the highest ranked hand may be 88%, whereas an unsuited 3 and 10 may be 5%, and the third hand (whatever it is) would have a probability of approximately 7%. In any case, the total of all of the percentages, one for each initial hand, would tend to equal 100%, although as is well known in Texas Hold'Em, ties are available between two or more hands when the 5 community cards forms a hand that can not be improved by any other cards in the partial hands or even the remainder of the deck. For example, the community cards may be a Royal Flush or Four Aces and a King. In the absence of wild cards, there are no cards that could improve the rank of the community cards, and all hands would have the same rank. This situation can be addressed in a number of ways. For example, the rank of the 5-card hand could be continued by high card ranks or pairs in the partial hand according to house rules. If high card rank were first used, then an Ace in the partial hand would cause the Royal Flush to be the next high hand (e.g., A-K-Q-J-10 of hearts and the Ace of Spades). If the total rank of the partial hand were to be considered, then a pair (such as a pair of 2's) would be higher than an Ace and another card.

When the probabilities of the different hands are shown, different pay scales for wagering on particular hands would be shown. For example, if the probability for the three hands were 50%, 25% and 25%, the pay tables for the return on wagering on the respective hands would reflect an inverse amount of return (not necessarily a 1/1 inverse, as the house may build in a retention factor on wagers) with respect to the likelihood of a particular hand winning. For example, with the percentages shown above, the approximate returns indicated on the paytables would be approximately X2 on the first hand and approximately X4 on the second and third hands. The house rules may also declare that when a hand ties it is a push or a loss for the player.

Enhanced paytables for each hand would then be shown (after the three partial hands are revealed), and the player would pick one of the partial hands to be the winning hand, paid at an enhanced level. As an alternative, a multiplier (in whole or fractional numbers) may be used: the 2 Aces may pay 1.5× the predetermined paytable, the unsuited 3 and 10 may pay 10× the predetermined paytable.

Instead of the player picking one of the hands to be the highest winning hand, the player may pick any one of the hands (whether it is the highest hand or not) for an enhanced or multiplied payout. For example, if the player picks the unsuited 3 and 10 for a 10× pay, that hand would have to achieve at least a minimum rank according to the predetermined paytable in order to win the wager, and then the win would be multiplied by 10. Of course if the hand ends up losing (either among the partial hands or by not reaching the rank required), then there is no 10× pay. Thus, the wager on the partial hands may be with respect to the particular partial hand winning, the particular partial hand reaching a predetermined rank, or both.

As noted above, the game may be played on standard video gaming equipment with appropriate software enabling the game, internet gaming systems, multiple player platforms, and even live casino table card games (which may be implemented by automated displays for the percentages, if that element of play is used.

Reference to the Figures will assist in further understanding of the practice of the present invention.

FIG. 1 shows a video game housing 2 with screen monitior 4, ten wagering option buttons 6, six bonus hand selection buttons 8, a max bet button 10, a deal button 12, a sample paytable for the 2-card and 5-card and 7-card hands 14, and the player's choice of a wager of 25 credits 16 to play the game. The wager of 25 credits 16 is allocated as follows: 3 credits are wagered on each of the six hands (20A, 20B, 20C, 20D, 20E, 20F), specifically 1 credit wagered in each hand for the initial partial hand (2-card hand), 1 credit wagered in each hand for the 5-card hand, and 1 credit wagered in each hand for the 7-card hand. The remaining 7 credits will be wagered on a bonus hand (See FIG. 2). The deal of six initial partial hands (22A, 22B, 22C, 22D, 22E, 22F) is shown. Also shown are the payouts (24A, 24B, 24C, 24D, 24E, 24F) for the initial partial hands as determined by the paytable 14.

Figure 2:
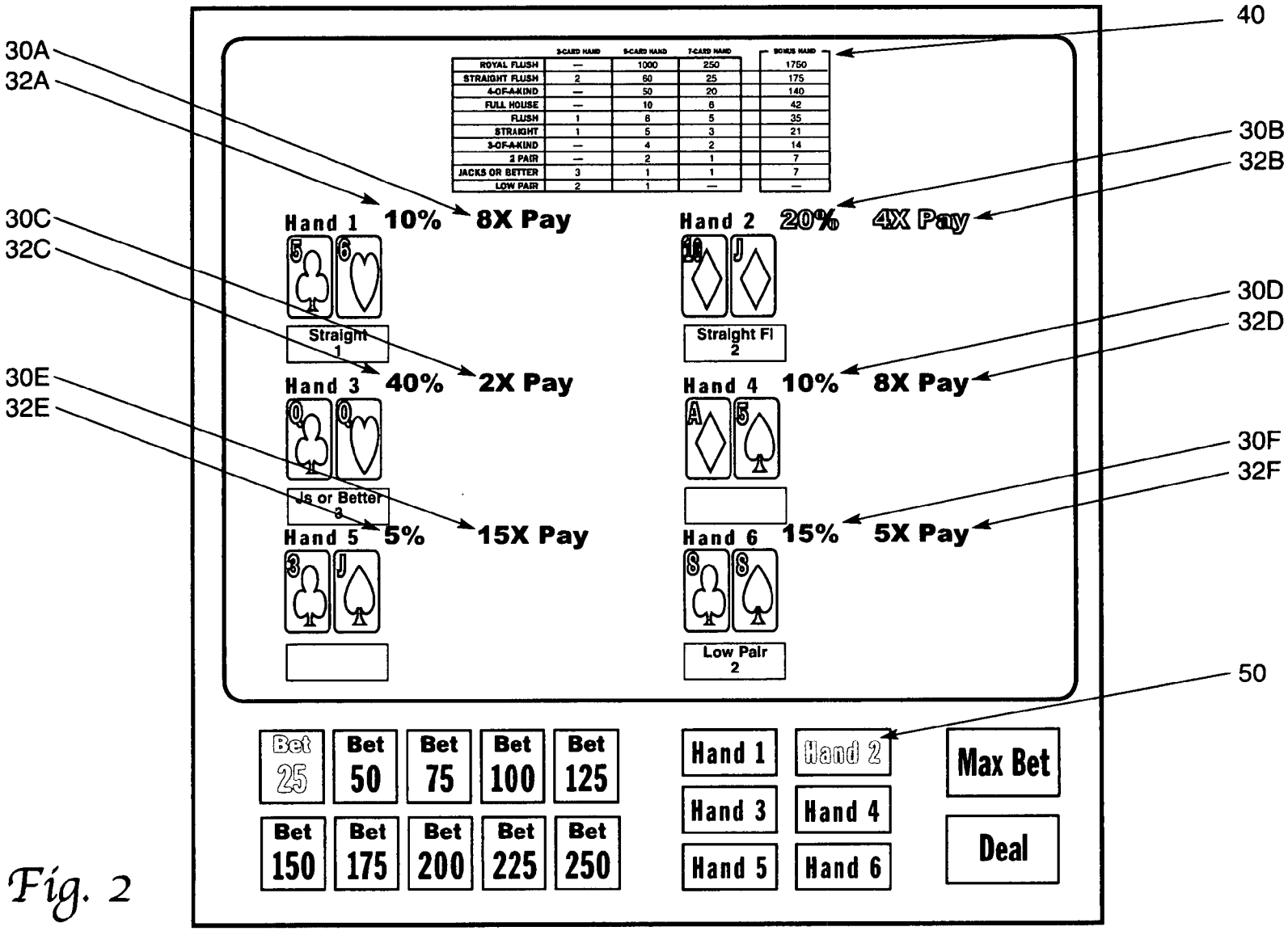
FIG. 2 shows the screen monitor for the use of this invention at a later stage of play.

FIG. 2 refers to FIG. 1, and shows the subsequent display of percentages (30A, 30B, 30C, 30D, 30E, 30F) that reflect the chances of each initial partial hand to eventually be the winning 7-card hand. Also shown are the relative multiplier rates (32A, 32B, 32C, 32D, 32E, 32F) for the separate paytable 40 for the bonus hand. The player's choice of the Hand 2 button 50 is shown, representing the player's decision to wager the remaining 7 credits on Hand 2. Hand 2's percentage 30B and multiplier 32B are shown highlighted in outline form.

Figure 3:
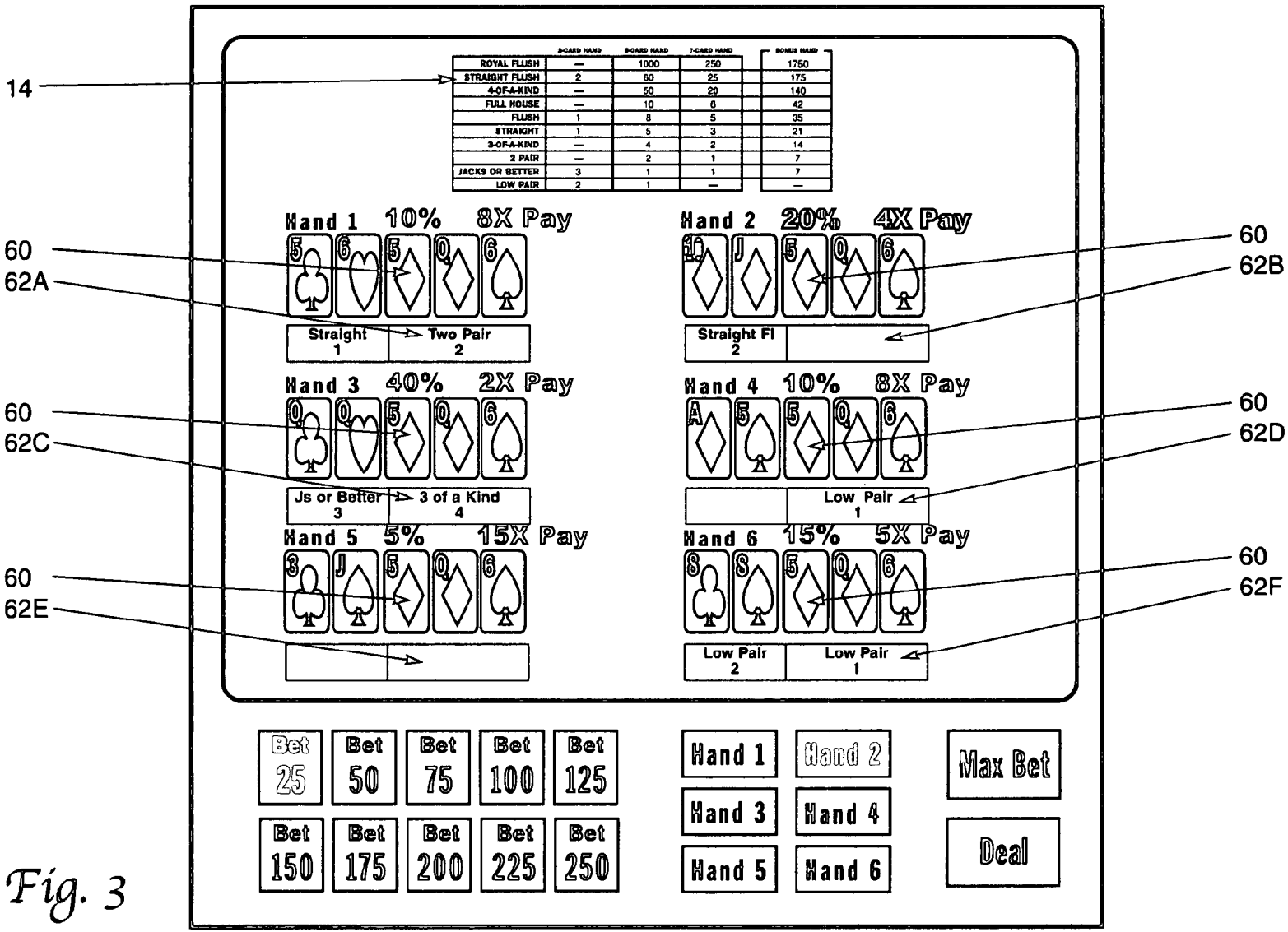
FIG. 3 shows the screen monitor for the use of this invention at a further stage of play.

FIG. 3 refers to FIG. 2, and shows the subsequent 3-card communal flop 60 of the 5 of Diamonds, the Queen of Diamonds and the 6 of Spades into each of the six hands. Also shown are the payouts (62A, 62B, 62C, 62D, 62E, 62F) for the 5-card hands as determined by the paytable 14.

Figure 4:
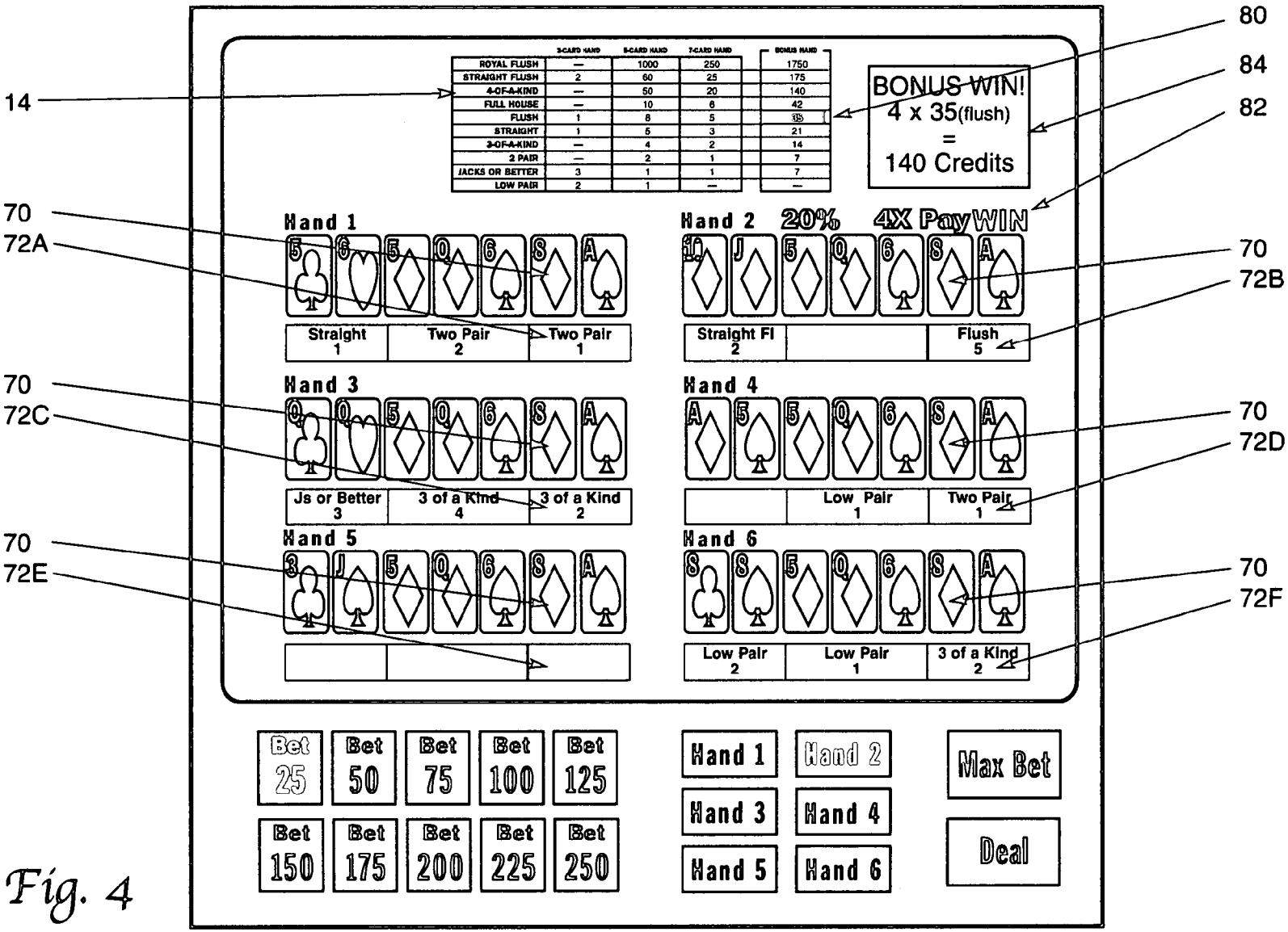
FIG. 4 shows the screen monitor for the use of this invention at a final stage of play.

FIG. 4 refers to FIG. 3, and shows the subsequent 2-card communal flop of the 8 of Diamonds and the Ace of Spades 70 into each of the six hands. Also shown are the payouts (72A, 72B, 72C, 72D, 72E, 72F) for the 7-card hands as determined by the paytable 14. Hand 2 is the highest winning hand (a Flush 72B) and the Flush payoff for the bonus wager is highlighted 80. A WIN symbol 82 is displayed, and the bonus win is explained and displayed in a display box 84.

Although specific examples and specific images have been provided in this discussion, these specifics are intended to be only support for the generic concepts of the invention and are not intended to be absolute limits in the scope of the technology discussed.

SPECIFIC EXAMPLES OF GAMEPLAY

The following descriptions of rounds of play are provided as specific support for the generic concepts described herein. The specific numbers and events of the examples are not intended to limit the scope of the technology claimed herein.

A. Player wagers an initial amount of credits (e.g., 25 credits) to play Z (6) hands of a final game of 7-card stud with cards dealt in a manner similar to the play of Texas Hold'Em.

B. In each of the six hands: 1 credit is wagered on the 2-card hand, 1 credit on the 5-card hand and 1 credit on the 7-card hand for a total bet on all parts (3 part) of the six hands being 18 credits.

C. The remaining 7 credits (25-18) are bet by the player on picking the final top winning hand. The player makes the selection by player input (buttons, keypad or touch screen, for example).

D. The initial pocket cards (2 cards) are dealt into each of the six hands. Predetermined pays are given for 2-card hand ranks of straights, flushes, straight flushes, low pairs and ranked pairs (e.g., 4's or better, Jacks or Better, etc).

E. Depending on the statistical percentages given to each pocket hand (which have been statistically analyzed in depth and which statistics are well known within the field) and the guess/strategy of the player, the player chooses one of the hands (along with its paytable presented for that particular hand) to ultimately become the top winning 7-card hand or to get a multiplied pay. It should be noted that the paytables for the probability for winning are based upon the particular collection of hands present on the table. For example, the probability of a pair of 9's winning any hand is not an absolute value. If the two other hands are both an unsuited 8 and 2, the probability will be relatively high. If the other two hands are a pair of Jacks and a pair of Aces, the probability will be considerably lower for the pair of nines to win. The published or displayed probabilities are therefore evaluated on the basis of the three hands (Z hands) at the table, and not on the basis of a single hand considered alone.

F. A first set of community cards (the 3 flop cards) are displayed and effectively associated into each hand. The resulting 5-card hands are evaluated for pays according to a separate paytable for 5-card poker games. Any wins are paid.

G. A set of two final community cards (the compilation of Fourth Street and the River card) are provided to the table and associated with each of the six hands. The resulting six 7-card hands are evaluated for pays according to a first general 7-card hand paytable. Any wins are paid.

H. All six of the 7-card hands are compared to each other and a best hand is determined. If the player's choice of the top winning hand is indeed the top winning hand, a bonus is paid. The bonus may be a fixed return on the initial wager (which fixed return is likely to be based at least in part on the total number (Z) of hands that were initially available for wagering. For example, selecting a winner from among six available partial hands should pay at a higher rate than selecting a winner from among three partial hands. An alternative payment would be where a separate enhanced paytable is used for the bonus hand. Another alternative payment would be a multiplier used in conjunction with the enhanced paytable. A further alternative would be where the chosen hand gets a multiplied win on the paytable event of step G.

I. Bonus amounts may be, by way of non-limiting examples, an increased paytable for the 7-card hand, a multiplier of the 7-card hand win (5× pay, for instance), a multiplier of the enhanced 7-card paytable win, a multiplier of the total win of the top hand (including the 2- and 5-card payouts), a wild card in the flop or one player's hand of the next round of play, a collective component that is being stored in a bonus event (e.g., letters in a Scrabble™ type bonus game, movement along a path in a trip-type game, game pieces in a game, projectiles in a target game or competitive game) etc.

J. As an alternate method to the play above, instead of the player picking one of the hands to be the highest winning hand, the player may pick any one of the hands (whether it is the highest hand or not) for an enhanced and/or multiplied payout. For example, if the player picks the unsuited 3 and 10 for a 10× pay, that hand would have to achieve at least a minimum rank according to the predetermined paytable in order to win the wager, and then the win would be multiplied by 10. Of course if the hand ends up losing (either among the partial hands or by not reaching the rank required), then there is no 10× pay. Thus, the wager on the partial hands may be with respect to the particular partial hand winning, the particular partial hand reaching a predetermined rank, or both.

Second Example

This example provides cards and wagers similar to the manner in which cards are provided in the final table of WSOP (World Series of Poker™ game). Play is similar to that described directly above, except 50 total credits are bet: 1 credit is bet on the 2-card hand, 2 credits are bet on the 5-card hand, and 2 credits are bet on the 7-card hand in each of the 9 hands (total 45 credits wagered). 5 credits are allotted for choosing the winning 7-card hand or for choosing an enhanced pay on one of the 9 hands.

Third Example

This example provides cards and wagers similar to the manner in which cards are provided in the final table of WSOP (World Series of Poker™ game). Play is similar to that described directly above, except no credits are bet and there are no payouts allowed on the 2-card hand. 1 credit is bet on the 5-card hand, and 1 credit is bet on the 7-card hand in each of the 9 hands (total 18 credits wagered). 7 credits are allotted for choosing the winning 7-card hand or for choosing an enhanced pay on one of the 9 hands.

The invention is claimed as follows:

1. A method of operating a gaming system, said method comprising:

(a) causing a processor to operate with a display device and an input device for a play of a poker game to:

(i) receive an initial wager of a quantity of credits from a player to play a quantity of at least two poker hands, wherein the quantity of credits of the initial wager is greater than the quantity of poker hands and the initial wager is placed prior to displaying any cards of any of the poker hands;

(ii) for each of the quantity of poker hands, display face-up a partial poker hand;

(iii) automatically apply a first amount of at least one credit from the initial wager of credits to each of the displayed partial poker hands, wherein the sum of all the first amounts of credits is less than the quantity of credits of the initial wager;

(iv) display individual probabilities for each of the quantity of partial poker hands winning in a final hand game against all of the other quantity of partial poker hands;

(v) after displaying the partial poker hands face-up, enable the player to select one of the displayed partial poker hands;

(vi) automatically apply a second amount of at least one credit from the initial wager of credits to the player selected partial poker hand, wherein the second amount of credits is equal to the initial wager of credits minus the sum of each of the first amounts of credits; and (vii) for each of the poker hands, determine and display a result; and (b) causing the processor to operate with the display device and the input device to provide any awards associated with said displayed results for the play of the poker game.

2. The method of claim 1, wherein for each of the quantity of partial poker hands, automatically applying the first amount of credits to each of the quantity of partial poker hands includes applying a portion of each first credit amount on each of the quantity of partial poker hands, an intermediate hand and a final hand.

3. The method of claim 1, which includes causing the processor to operate with the display device to display individual probabilities of winning for each of the quantity of partial poker hands before the player is enabled to select one of the displayed partial poker hands.

4. The method of claim 3, which includes causing the processor to operate with the display device to display payout rates for each of the quantity of partial poker hands.

5. The method of claim 1, wherein the quantity of poker hands is 5.

6. The method of claim 1, wherein each of the quantity of partial poker hands includes two cards.

7. The method of claim 1, which includes causing the processor to operate with the display device to display distinct payout rates for each of the displayed individual probabilities.

8. The method of claim 1, wherein the first amount of credits is equal to (the initial wager of credits minus the second amount of credits), divided by the quantity of poker hands.

9. The method of claim 1, which includes causing the processor to operate with the display device to display a rank of at least one of the partial poker hands before the results of each of the quantity of poker hands are determined and displayed.

10. The method of claim 1, which includes causing the processor to operate with the display device to display a potential final rank of at least one of the partial poker hands before the results of each of the quantity of poker hands are determined and displayed.

11. The method of claim 1, which is provided through a data network.

12. The method of claim 11, wherein the data network is an internet.

* * * * *

UNITED STATES PATENT AND TRADEMARK OFFICE

CERTIFICATE OF CORRECTION

PATENT NO. : 8,403,739 B2
APPLICATION NO. : 13/325975
DATED : March 26, 2013
INVENTOR(S) : Kathleen Nylund Jackson It is certified that error appears in the above-identified patent and that said Letters Patent is hereby corrected as shown below:

IN THE CLAIMS

In Claim 1, Column 10, Line 42, replace “at least one” with --one or more--.
In Claim 1, Column 10, Line 43, replace “credit” with --credits--.
In Claim 1, Column 10, Line 44, replace “the” with --a--.
In Claim 1, Column 10, Line 54, replace “at least one” with --one or more--.
In Claim 1, Column 10, Line 55, replace “credit” with --credits--.
In Claim 2, Column 11, Line 2, replace “credit amount” with --amount of credits--.
In Claim 3, Column 11, Line 6, after the second instance of “display” insert --the--.

Signed and Sealed this
Fourth Day of June, 2013

Teresa Stanek Rea
*Acting Director of the United States Patent and Trademark Office*